United States Patent [19]

Darzinskis

[11] 4,261,276

[45] Apr. 14, 1981

[54] SAILING BOOMS

[76] Inventor: Kazimir R. Darzinskis, 1150 Randville Dr., Palatine, Ill. 60067

[21] Appl. No.: 51,045

[22] Filed: Jun. 22, 1979

[51] Int. Cl.[3] ..... B63H 9/04
[52] U.S. Cl. ..... 114/104
[58] Field of Search ..... 114/39, 97, 98, 95, 114/102, 104, 105, 108

[56] References Cited

U.S. PATENT DOCUMENTS

| | | | |
|---|---|---|---|
| 2,561,253 | 7/1951 | Wells-Coates | 114/102 |
| 3,118,415 | 1/1964 | Bradley | 114/98 |
| 3,310,017 | 3/1967 | Dyer | 114/98 |

*Primary Examiner*—Trygve M. Blix
*Assistant Examiner*—Jesus D. Sotelo

[57] ABSTRACT

This invention relates to a boom, sail and sail attachment rig such as used in sailboats, iceboats, and other objects propelled by wind, and in particular to improved aerodynamic curvature of the sails whereby greater wind power is achieved.

5 Claims, 4 Drawing Figures

SAILING BOOMS

In recent years it has been realized that under most wind direction conditions the suctional negative pressure on the leeward surface of a sail causes more drive than the positive pressure on the windward surface. To achieve optimal negative pressures leeward of the sail it is necessary for the sail to be of such horizontal contour as to permit the air-stream to flow by and past the sail in an efficient manner.

There exists today some argument as to the shape of the most efficient airfoil for low velocity applications. Traditional thought has favored the streamlined teardrop contour but more recent thought has tended to favor the symmetrical convex airfoil which this invention embodies although the streamlined teardrop contour could easily also be incorporated by this invention by simply changing the location or locations of the hinged joints of the boom here revealed.

State of the art booms presently are either flexible or rigid. Flexible booms are meant to bend in response to wind pressures from the sail or in response to manually controlled braces. The object of providing such bending capability is to predispose the adjacent sail area to assume a more aerodynamically efficient contour. Rigid booms do not, of course, provide this capability but instead require "wind to fill the sails" and only after this occurs do the sails assume an aerodynamically efficient contour and a significant fraction of the theoretical wind power is thus wasted—especially in light winds typical to inland waterways. A major deficiency in the state of the art in flexible booms is that the most efficient aerodynamic contour is not achieved by the force of the wind alone. The magnitude of these booms' flexure is proportional to the wind velocity against the sail. In strong winds, when it is actually desirable for the sail to be sheeted flatter, the boom bends a great deal. And in light winds, when it would actually be desirable for the sails to be sheeted fully, i.e.: having a great deal of curvature, the boom bends very little. Thus the effect of the booms' flexure in respone to the wind conditions is the exact opposite of the ideal.

Bracing and rigging and boom adjusting devices have been devised to attempt to correct this problem—most notably by S. Dyer Pat. No. 3,310,017, W. W. Wells-Coates Pat. No. 2,561,253 and E. Bradley Pat. No. 3,118,415—but these are cumbersome, cannot be easily employed simultaneously as the correct attitude of the sail and boom is set and thus have not gained significant acceptance in practice.

The principal object of this invention is to provide a simple, rugged, light and readily self-positioning boom, sail, and sail attachment rig, the constructions of which are such that the boom, sail, and sail attachment rig assume automatically (under wind action alone) a horizontal contour of maximum aerodynamic efficiency in the interest of power and speed.

Another principal object of this invention is to provide a simple, rugged, light and readily self-positioning boom and sail attachment rig, the constructions of which are such that the same can be installed in the average type of sailboat, iceboat, etc., without reconstruction and at low cost.

Another object is to provide a simple and practical assemblage, the construction of which will allow the curvature of the sail to be adjusted, when underway and drawing, to suit prevailing wind velocities thus eliminating the need for changing suits of sails.

Yet another object of this invention is to eliminate the need for braces, length adjustors, manually controlled winches and battens or other manually controlled devices to control camber of the sail so that the sail will trim most efficiently on any point of sailing and any wind velocity.

Yet another object of this invention is to simplify the efficient operation of a sailboat, iceboat, etc., by reducing the amount of human involvement in properly trimming the sails.

Yet another object is to provide increased safety against the hazards of sudden wind gusts and against the hazards of an out-of-control swinging boom.

To the accomplishment of the foregoing objects and other objects as may become apparent, this invention consists in the novel construction and arrangement of parts hereinafter described in detail and then defined in the appended claims. Reference is had to the accompanying drawings as an example merely for the purpose of illustration, preferred embodiments of this invention which is in no way intends a limitation upon the scope of the appended claims in the light of prior art. It is expressly understood that changes and modifications may be made in practice within the scope of said claims when found expedient. In particular, it is expressly understood that the boom assembly and sail attachment rig may be combined to form a single continuous flexible member whose opposite ends are connected by a coil spring and that such an embodiment shall come within scope of all of the appended claims.

Figure 1:
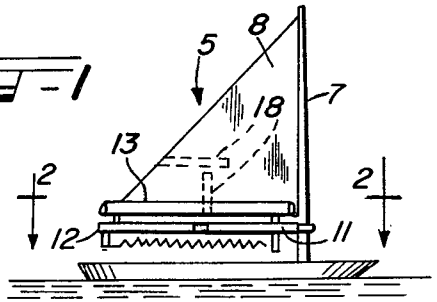
FIG. 1 is a side view in elevation of a boat, vessel, iceboat, or the like equipped with a mast, main sail, boom and sail attachment rig made in accordance with this invention.
Figure 4:
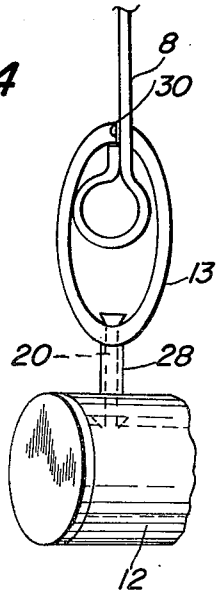
FIG. 4 is an enlarged aft end view of the boom and sail attachment rig taken along line 4—4 of FIG. 2.

Referring to the drawings a sailboat 5 of conventional sail construction is shown which includes features of this invention, which features can be readily applied to other types of vessels, iceboats, windmills, and the like.

The sailboat illustrated is shown to include a hull 6 and a mast 7, which mast may be of any cross sectional shape, and mounted thereupon in any conventional manner.

The sail 8 illustrated to be of the type that is attached to the mast 7 by means of a slotted section of the mast 7, extending nearly the entire height of the mast 7. Such slotted section is not shown for purposes of clarity.

The boom assembly 9 consists of a gooseneck 10, a pair of essentially hollow tubes 11, 12, sail attachment rig 13, a circular leaf spring 14, a coil spring 15 in tension, and various connecting devices. The boom assembly 9 pivots around the mast 7 by means of a gooseneck 10 which is attached to the mast in any conventional manner. The gooseneck 10 is connected to a hollow tube 11. Attached to the aft end of the tube 11 is one of the two tongues of a hinge 16. The other tongue of the hinge 16 is attached to the fore end of the other tube 12 so as to allow the tubes 11, 12 to assume any position relative to each other in the horizontal plane. Small bail members 21, 22 are provided at the top of each tube 11, 12 and the lower portion of the sail attachment rig 13 are provided with grommets 23, 24 to accommodate short ropes 25, 26, which ropes connect the portions of sail attachment rig 13 inward of its fore and aft terminations to the tubes 11, 12, said ropes of such length so as to slightly flatten the curvature of the sail attachment rig 13. Thus, the configuration of the sail attachment rig 13 is determined by the configuration of the tubes 11, 12. Contained within and between the tubes 11, 12 is a circular leaf spring 14 which is constructed of circular spring steel rod tapered from the aft end to the fore end, its position within the tubes being adjustable by means of a threaded hole 17 on the upperside of the fore tube 11 through which is placed a bolt which will abut the upper side of the spring 14. Since the diameter of the leaf spring 14 within the tubes 11, 12 is not constant, the bending moment tending to keep the tubes 11, 12 in a straight line, i.e.: enclosing an angle of 180 degrees, may be adjusted by selecting the diameter (and thus the moment) of the leaf spring 14 between the tubes 11, 12 by positioning the spring 14 and locking it by means of a screw through the hole 17.

Secured to the underside of the fore tube 11 and extending downwardly is a pin 32 whose purpose is to anchor one end of a coil spring 15. The aft tube 12 is similarly provided a downwardly extending pin 33. To provide the capability of adjusting the tension of the coil spring 15 while sailing, a slot 34 is provided on the underside of the tube 12 to accommodate the head of a threaded bolt 31, which bolt 31 can be moved foreward or aftward in the slot and be secured in position against the underside of the tube by means of a nut. Other nuts can be employed to attach and fix the position of the end of the coil spring 15.

Figure 2:
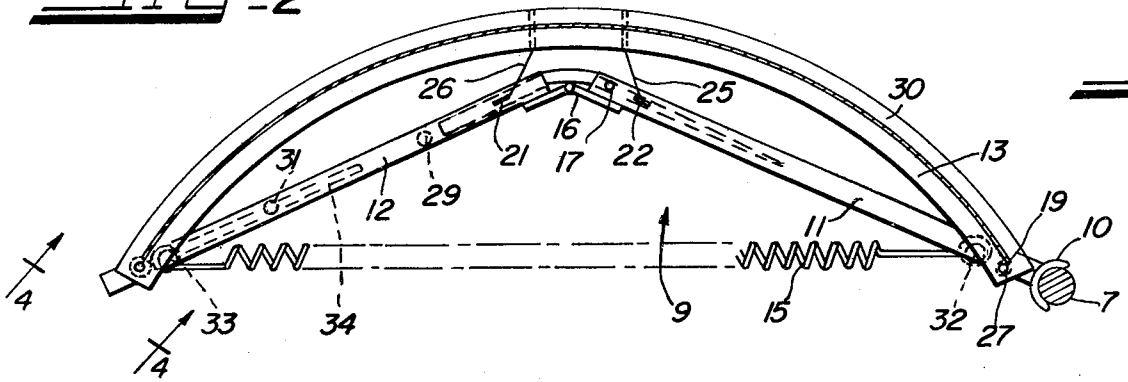
FIG. 2 is an enlarged sectional plan view of the mast and boom taken along line 2—2 of FIG. 1.
Figure 3:
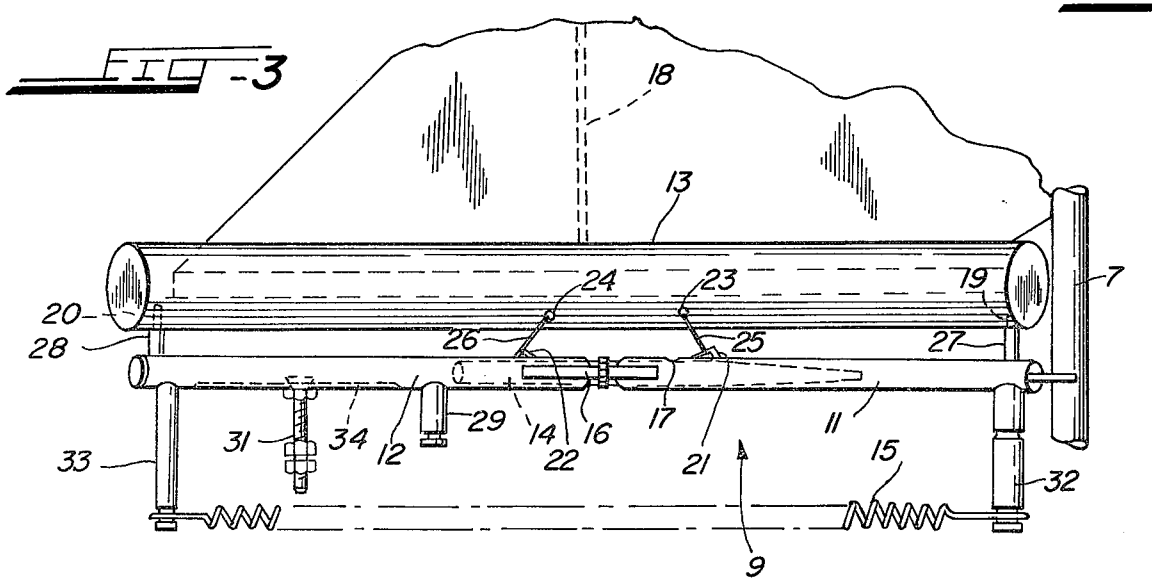
FIG. 3 is a fragmented side elevational view of the parts shown in FIG. 2 plus a fragmented view of the main sail.

The sail attachment rig 13 is a symmetrical, semi-flexible, long member whose purpose is to provide attachment means for the foot of the sail 8, and to provide constraints on the position of the foot of the sail so as to provide maximum aerodynamic speed and power. To these ends the sail attachment rig is of a cross section and modulus of elasticity to promote bending in the horizontal plane rather than in the vertical plane and to promote a smooth curvature in the horizontal plane, and the smooth curvature in the horizontal plane is why the sail attachment rig 13 is semi-flexible rather than flexible. The fore and aft terminations of the sail attachment rig 13 are attached to boom tubes 11, 12 by means of pins 19, 20 which allow for movement of the sail attachment rig 13 around the pins 19, 20 by means of loose fitting collars 27, 28 around the pins 19, 20. Bowing of the sail attachment rig is constrained by means of the ropes 25, 26 attached to the tubes 11, 12 which said ropes also serve to prevent any significant vertical curvature of the sail attachment rig 13. The length of the said ropes 25, 26 and the longitudinal length and the bowing of the sail attachment rig 13 are exaggerated in FIG. 2 for clarity. FIG. 2 does accurately reflect the intended comparative lengths of the sail attachment rig 13 vis a vis the length of the tubes 11, 12 circumscribed by the sail attachment rig in that the former is slightly greater. Said ropes 25, 26 could be used to operate the sail attachment rig 13 manually if it were to be mounted on a conventional rigid boom. Various longitudinal and vertical battens 18 may be enclosed within the sail 8 to expand the portion of the sail 8 which is predisposed by the sail attachment rig to assume a bellied horizontal contour for maximum aerodynamic drive.

The foregoing description makes apparent that the circular leaf spring 14 and the sail attachment rig 13 both exert forces under normal wind conditions that tend to bring the angles enclosed by the tubes 11, 12 to 180 degrees, while the coil spring 15 tends to make the said enclosed angle smaller than 180 degrees. The closer the said enclosed angle is to 180 degrees the stronger will be the force exerted by the coil spring 15, as the force exerted by said spring is directly proportional to its length. The afore mentioned features which provide bending moment adjustability to each of the counteracting springs, namely the circular leaf spring 14 and the coil spring 15, thus provide the boom assembly 9 to be brought into a state of equilibrium by balancing the moments of the said springs against the moment developed through the sail attachment rig 13 from the prevailing wind, and furthermore allow a state of equilibrium which provides maximum aerodynamic efficiency by appropriate bellying changes of the lower part of the sail 8 in response to changing wind conditions.

The difference in length of the sail attachment rig 13 compared to the length of the tubes 11, 12 (including attachment devices) circumscribed by the sail attachment rig 13 is chosen to be such dimension that when the angle enclosed by the tubes is within $\pm 5$ degrees of 180 degrees, the smooth longitudinal countour of the sail attachment rig 13 and of the foot of the sail 8 will be destroyed by the pull on the said rig toward said tubes by the ropes 25, 26. The effect of the above will be to temporarily reduce the suctional force on the sail while changing from a starboard tack or reach to a port tack or reach or vice versa and while an unexpectedly strong gust of wind threatens to overcome the pulling action of the coil spring 15, thus threatening to invert the boom assembly.

In the light of the disclosures hereinabove revealed it is clear that my invention is suceptible to various embodiments and is not limited to the particular constructions shown. The principal principles of the illustrations shown are the constructions of a flexible boom assembly whose response to the wind forces in both very light and in very heavy winds is appropriate toward the goal of predisposing the foot of a sail to assume the most advantageous contour for power, efficiency, and safety and of a semi-rigid sail attachment rig, which, when attached to a flexible boom of the type herein revealed, predisposes the foot of the sail to assume a contour of maximum aerodynamic efficiency both strong and light winds. It is expressly understood that the flexible boom assembly without incorporating the sail attachment rig herein revealed can be considered part of an invention in and of itself in that any of the existant conventional sails and sail foot attachments can advantageously and in a novel manner be employed with the flexible boom assembly without the sail attachment rig herein revealed. Similarly, the sail attachment rig herein revealed is understood to be part of an invention in and of itself, as it can be advantageously and in a novel manner employed with any existant conventional sail booms as well as with the boom herein revealed. It is expressly understood, furthermore, that this invention anticipated a construction of a sail boom which combines the sail attachment rig herein revealed and the flexible boom assembly herein revealed into a single, continuous long and flexible member, as the construction here revealed in no way limits the number of tubes and circular leaf springs employed and when the number of tubes and said springs employed is one per foot of boom length or a greater number, the boom assembly will bend essentially the same as the sail attachment rig, if the fore and aft terminations are equipped with a coil spring of the type herein employed and if proper allowances are provided in the cross section bending modului of said combined construction along the length of the combined construction.

What is claimed is:

1. The combination of a sail, sail attachment means, and variable, automatically adjusting, camber inducing boom interconnected to each other having a propulsive area for assuming a horizontal contour of aerodynamic advantage, said boom comprising: a plurality of stiff tubular members, each said member hinged to each neighboring member so as to allow free rotation exclusively in the horizontal plane of each said member, each said member normally being urged in a horizontal direction by at least one of a portion of a leaf spring enclosed within each said member and a sail acting through sail attachment means near the fore and aft terminations of the foremost and aftmost tubular members, respectively to assume a position with relation to all neighboring members such that the angle enclosed is 180 degrees; at least one coil spring normally in tension, said coil springs engaging any of a number of spring attachment means projecting downward from at least two of the aforementioned stiff tubular members, said coil springs normally urging said tubular members to assume horizontal positions, with relation to other said tubular members, that are less than 180 degrees; means provided the upper surface of the aftmost and foremost of the said tubular members to provide capability for connecting the foot of a sail or sail assembly, said means each consisting of a hole to accommodate a screw, bolt, pin, rope, or other common connector.

2. In combination, a sailing vessel having a mast, a boom, a sail, and a sail attachment member, said sail attachment member consisting of an elongated structural member of semi-rigid materials and of longitudinally constant cross section and modulus of elasticity and of much greater height than width to prevent deflection thereof except in the horizontal plane, said sail attachment member having a substantially straight upper edge and substantially straight lower edge, said sail attachment member having substantially the same cross section intermediate the ends thereof, said sail attachment member having a vertical hole provided near each end so as to accommodate a loose fitting pin or other similar means to simultaneously secure the sail attachment member to the fore and aft terminations of a boom and to allow rotation of each end of said sail attachment member about the axis of each said pin so as to render the sail attachment member capable of flexure to bowed formation in the horizontal plane, the length of said sail attachment member being at least equal to the length of the boom circumscribed by the sail attachment member, said sail attachment member provided with a number of grommets for engagement by rope means for the purpose of breaking the smooth bow to invert the bow or to otherwise modify the shape of the bow of the said sail attachment member.

3. The combination of claim 1 wherein the coil springs are infinitely adjustable, said adjustability provided by means of a headed, threaded bar, said bar being free to slide within a long slot located on the underside of any of the aforementioned stiff, tubular members, said head of the bar being larger than the slot but smaller than the tubular members, said bar having threads to engage any number of nuts to secure its position against the underside of the said tubular member and to secure one end of the coil spring.

4. The combination of claim 1 wherein the coil springs are discretely adjustable, such adjustability provided by means of a series of hook means extending from the underside of the stiff, tubular members, said hook means being of such shape and size so as to allow the attachment of one end of a coil spring connecting device and so as to prevent interference of the coil springs from other hook means.

5. The combination of claim 1 wherein the leaf spring is an adjustable tapered circular leaf spring confined within the boom's tubular members and bridging the gap between said tubular members, said leaf spring being of shorter length than the combined length of said tubular members, said leaf spring being manually positionable in relation to said tubular members and its selected position being lockable in place by means of threaded hole in any of the said tubular members and a screw, said leaf spring by means of its taper and of its positionability thus providing adjustability to the bending moment between said tubular members.

* * * * *